United States Patent [19]

Allen, Jr.

[11] 4,245,799

[45] Jan. 20, 1981

[54] TEXTILE BOBBIN

[75] Inventor: Frank L. Allen, Jr., Hopedale, Mass.

[73] Assignee: Rockwell International Corporation, Pittsburgh, Pa.

[21] Appl. No.: 40,367

[22] Filed: May 18, 1979

[51] Int. Cl.[3] ..... B65H 75/10

[52] U.S. Cl. ..... 242/118.3; 242/118.31

[58] Field of Search ..... 242/118.32, 118.31, 242/118.3, 118

[56] References Cited

U.S. PATENT DOCUMENTS

| | | | |
|---|---|---|---|
| 379,151 | 3/1888 | Boynton et al. | 242/118.31 |
| 2,403,417 | 7/1946 | Van Deventer | 242/118.31 |
| 3,498,554 | 3/1970 | Hare | 242/118 |

FOREIGN PATENT DOCUMENTS

| | | | |
|---|---|---|---|
| 8556 | 6/1894 | Switzerland | 242/118.31 |
| 226683 | 1/1925 | United Kingdom | 242/118.3 |
| 1448410 | 9/1976 | United Kingdom | 242/118.3 |

*Primary Examiner*—Stanley N. Gilreath

[57] ABSTRACT

An improved bobbin for use in conjunction with automatic yarn winders, the bobbin comprising a butt portion, an elongated barrel portion that terminates in an outer end of reduced size and a resilient cup-like tip mounted over the bobbin's outer end, the bobbin having an annular recess shaped to receive an inwardly directed flange formed on the cup-like tip to secure the cup-like tip on the reduced outer end of the bobbin barrel.

2 Claims, 2 Drawing Figures

TEXTILE BOBBIN

BACKGROUND OF THE INVENTION

In certain types of textile equipment, specifically weaving machinery or looms, in which shuttles are used which contain their own supply of weft yarn on bobbins mounted in the shuttle, it is necessary that the bobbin be re-wound with a new supply of yarn when the original supply is depleted. Textile bobbins are characteristically re-supplied with a quantity of weft yarn by means of automatic winding machines such as the Unifil winder produced by the Leesona Corporation. Generally, bobbins for winder use have a very short useful lifetime due to wearing of the tip of the bobbin. When the tip wears, it becomes rough, causes breakage of the weft yarn and also results in malfunction of the winding machine. In the past, textile manufacturers have attempted to overcome the problem of tip wear by capping the ends of the bobbin with a wear resistant tip made of metal, plastic or the like. Generally, the method for capping the tip end of the bobbin has been by means of fastening devices such as screws or by merely cementing or molding the tip over the end of the bobbin. All of these methods are slow, expensive and further leave a line of demarcation between the end of the bobbin tip and the remainder of the bobbin barrel in which the weft yarn can become wedged and break.

It is a principle object of this invention to provide a new textile bobbin in which the outer or tip end of the bobbin is protectecd by a cup-like tip;

An additional object of this invention is to provide an improved bobbin construction with a wear resistant tip in which there is no gap between the applied tip and the remainder of the bobbin barrel.

Other objects and advantages of this invention will be in part obvious and in part explained by reference to the accompanying specification and drawings in which:

DESCRIPTION OF THE PREFERRED EMBODIMENT

The bobbin construction of this invention is fast in application and can be expeditiously done at a textile mill to repair damaged bobbin tips. The plastic of the cup-like tip is molded slightly undersized and snapped onto an appropriately formed receiving portion on the bobbin. The preferred materials for the wear resistant tip are those plastics which are resilient, hard and which have low creep in order that they may be snapped on to the preformed end of the bobbin.

Figure 2:
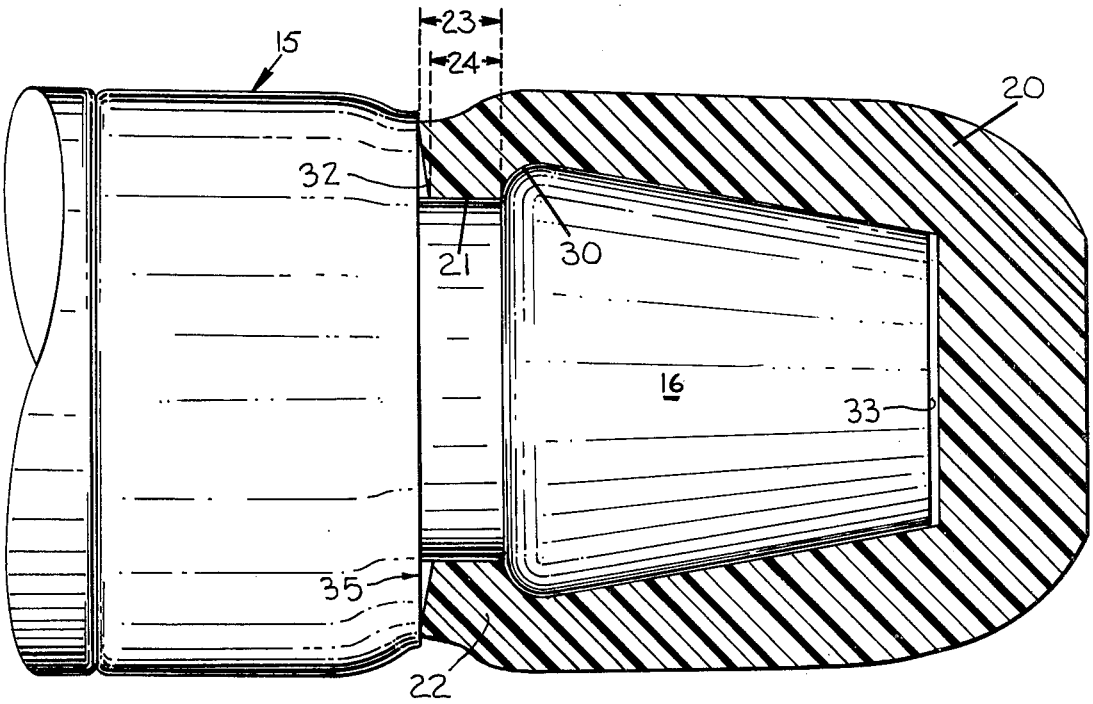
FIG. 2 is a side elevation of an entire bobbin in accordance with this invention.

Referring to FIG. 2 of the drawings, the improved bobbin construction comprises an enlarged butt portion 10 which has rings 11 for reception into the clamping spring of a weaving shuttle (not shown). The bobbin shown in FIG. 2 also includes a plurality of yarn cleats 12 on the right hand or upper side of butt 10, these cleats normally being present on the type of bobbin that is used in automatic bobbin winding machines.

An elongated barrel 15 extends outwardly from butt portion 10 and terminates in an outer end 16 of reduced size. Mounted on the outer end 16 of barrel 15 is a resilient cup-like tip 20 which protects the outer end of barrel 15 from excessive wear and damage.

Figure 1:
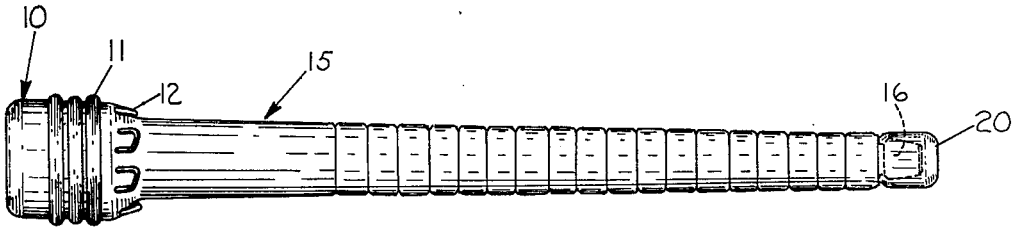
FIG. 1 is an enlarged, partly sectional, side elevation of the tip portion of the textile bobbin according to this invention.

As it is already known, to utilize protective tips of textile bobbin, as shown in U.S. Pat. No. 2,403,417, which issued July 2, 1946, the improvement which this invention offers is that of providing a protective tip which can be readily and yet securely mounted on the end of a bobbin and which presents no area of demarcation between the protective tip and the remainder of the bobbin barrel which could catch and break the weft yarn. Specifically, means defining an annular recess 21 in the bobbin barrel is the area between the base of the reduced end 16 and the remainder of the barrel 15. The resilient cup-like tip 20 has an enlarged inwardly directed flange 22 which is received into the annular recess 21 to hold the tip 20 on the reduced outer end 16 of barrel 15. As clearly shown in FIG. 1, the flange 22 is shaped for reception into recess 21 but the flange is of a greater width 23 on its exposed outer portion than is its inner portion 24 that is adjacent the wall defining annular recess 21. It will further be noted that the outermost limit of annular recess 21 is defined by a rounded shoulder 30 on reduced end 16 and that the inner part of flange 22 has been configured to conform to the shape of shoulder 30.

The innermost limit of annular recess 21 is defined by a shoulder 35 having a surface whose plane is normal to the longitudinal axis of the bobbin. It will be noted that the height of inner shoulder 35 is greater than the height of the inwardly directed flange 22 so that a small portion of inner shoulder 35 usually extends beyond the outer surface of flange 22.

It will be noted that the size of flange 22 and the size and width of the annular recess 21 is such that a space 32 exists between the rear surface of the flange and the inner shoulder 35. This space is purposefully present to accommodate shrinking and swelling which normally occurs in wood bobbins. The space 33 allows for the movement caused by the slope at 30 forcing the plastic tip against the wood.

Although the present invention has been described in connection with a preferred embodiment, it should be understood that modifications and variations may be resorted to without departing from the spirit and scope of the invention as those skilled in the art will readily understand. Such modifications and variations are considered to be within the purview and scope of the appended claims.

What I claim as new and desired to secure by Letters Patent of the United States are:

1. In a textile bobbin of the type having a butt portion for reception into the clamping spring of a weaving shuttle, an elongated barrel extending outwardly from the butt portion, the barrel portion terminating in an outer end of reduced size, and a resilient cup-like tip mounted over the reduced outer end to protect it from excessive wear and damage, the improvement comprising an annular recess in the bobbin barrel at the base of the reduced end defined by a rounded shoulder on the bobbin's outer end of reduced size and an annular shoulder having a surface whose plane is normal to the axis of the bobbin, and a resilient cup-like tip having an enlarged inwardly directed flange received within said annular recess to hold said tip on the outer end portion of the bobbin, said flange being shaped for reception into said annular recess and being of a width on its exposed outer portion which is greater than the width of its inner portion and being of a height which is less than the height of said recess' inner shoulder.

2. A bobbin as defined in claim 1 wherein spaces are provided between the flange of said cup-like tip and the inner shoulder of said annular recess and between the outer end surface of said outer end of reduced size and said cup-like tip.

* * * * *